US008454757B2

(12) United States Patent
Feenstra et al.

(10) Patent No.: US 8,454,757 B2
(45) Date of Patent: Jun. 4, 2013

(54) PHOSPHATE AND PHOSPHONATE-FREE AUTOMATIC GEL DISHWASHING DETERGENT PROVIDING IMPROVED SPOTTING AND FILMING PERFORMANCE

(71) Applicant: Access Business Group International LLC, Ada, MI (US)

(72) Inventors: Douglas K. Feenstra, Wyoming, MI (US); Ronald C. Jackson, Wyoming, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 13/688,482

(22) Filed: Nov. 29, 2012

(65) Prior Publication Data

US 2013/0090281 A1 Apr. 11, 2013

Related U.S. Application Data

(60) Division of application No. 12/851,056, filed on Aug. 5, 2010, now Pat. No. 8,343,904, which is a continuation-in-part of application No. 12/017,446, filed on Jan. 22, 2008, now Pat. No. 7,781,387.

(51) Int. Cl.
*B08B 7/04* (2006.01)

(52) U.S. Cl.
USPC ..... 134/25.2; 134/18; 510/220

(58) Field of Classification Search
USPC ..... 134/25.2, 18; 510/220
See application file for complete search history.

(56) References Cited

U.S. PATENT DOCUMENTS

| | | | | |
|---|---|---|---|---|
| 4,545,917 | A | 10/1985 | Smith et al. | |
| 5,084,198 | A * | 1/1992 | Ahmed et al. | 510/223 |
| 5,256,327 | A | 10/1993 | Allen et al. | |
| 5,777,090 | A * | 7/1998 | Verraest et al. | 536/4.1 |
| 5,856,451 | A * | 1/1999 | Olsen et al. | 530/402 |
| 6,119,705 | A | 9/2000 | Getty et al. | |
| 6,331,512 | B1 * | 12/2001 | Foote et al. | 510/226 |
| 6,559,301 | B1 | 5/2003 | Kuzee et al. | |
| 6,844,305 | B1 | 1/2005 | Depoot et al. | |
| 6,921,743 | B2 * | 7/2005 | Scheper et al. | 510/220 |
| 7,473,672 | B2 | 1/2009 | Kotlar et al. | |
| 7,597,766 | B2 | 10/2009 | McRae et al. | |
| 7,781,387 | B2 | 8/2010 | Feenstra et al. | |
| 2003/0022805 | A1 * | 1/2003 | Clare | 510/220 |
| 2006/0166853 | A1 * | 7/2006 | Feyt | 510/470 |
| 2007/0017553 | A1 * | 1/2007 | Neplenbroek et al. | 134/25.2 |
| 2007/0207940 | A1 * | 9/2007 | Fenyvesi et al. | 510/276 |
| 2007/0241306 | A1 * | 10/2007 | Wehner et al. | 252/67 |
| 2008/0221006 | A1 | 9/2008 | Heisig et al. | |
| 2008/0233057 | A1 * | 9/2008 | Viladot Petit et al. | 424/49 |
| 2008/0293607 | A1 * | 11/2008 | Jones et al. | 510/226 |
| 2009/0105114 | A1 * | 4/2009 | Stolte et al. | 510/446 |
| 2009/0186795 | A1 * | 7/2009 | Feenstra et al. | 510/226 |
| 2010/0298192 | A1 | 11/2010 | Feenstra et al. | |

FOREIGN PATENT DOCUMENTS

| | | |
|---|---|---|
| EP | 1 408 103 | 4/2004 |
| EP | 1 409 627 | 11/2005 |
| EP | 1 094 890 | 3/2006 |
| JP | 2007/320927 | 12/2007 |
| WO | WO 97/20907 | 6/1997 |
| WO | WO 99/64143 | 12/1999 |
| WO | WO 2004/041984 | 5/2004 |
| WO | WO 2009/037012 A2 | 3/2009 |
| WO | WO 2009/037013 A2 | 3/2009 |
| WO | WO 2009/094073 A2 | 7/2009 |

OTHER PUBLICATIONS

Search Report for European Patent Application Serial No. EP 11 17 3786, dated Nov. 9, 2011, 6 pages.

* cited by examiner

*Primary Examiner* — Mark Eashoo
*Assistant Examiner* — M. Reza Asdjodi
(74) *Attorney, Agent, or Firm* — Brinks Hofer Gilson & Lione; G. Peter Nichols

(57) ABSTRACT

A phosphate and phosphonate-free gel automatic dishwashing detergent provides improved spotting and filming performance by including a spot reduction system that contains a combination of a polyacrylate and a carboxymethyl inulin. The gel detergent may also be free of a bleach ingredient (i.e., it does not contain either chlorine bleach or an oxygen bleach).

14 Claims, 3 Drawing Sheets

Spotting and Filming Performance of Spot Reduction System in Gel Automatic Dishdetergent of the Present Inventin

PHOSPHATE AND PHOSPHONATE-FREE AUTOMATIC GEL DISHWASHING DETERGENT PROVIDING IMPROVED SPOTTING AND FILMING PERFORMANCE

This application is a divisional of and claims the benefit of priority from U.S. application Ser. No. 12/851,056, which is a continuation-in-part of U.S. Pat. No. 7,781,387, of which the disclosure of each is hereby incorporated by reference in their entirety.

The present invention relates to automatic dishwashing compositions, and more particularly to a non-phosphate (i.e., phosphate-free) and non-phosphonate (phosphonate-free) dishwashing composition. The compositions of the present invention may be provided in a dry form (e.g. a free-flowing powder) or in a gel form. The composition of the present invention provides improved spotting and filming performance even when the dishes are washed in water having a hardness of 15 grains or greater.

BACKGROUND

Automatic machine dishwashers are widely used to clean soiled dishes, cooking utensils and other containers for serving and preparing food, such as plates, cups, glasses, silverware, pots, pans, etc., generically referred to as "dishes". While the construction and composition of dishes vary widely, most usually have glossy, solid surfaces on which the presence of dried water spots and filming is readily noticeable. The dried water spots and film are aesthetically unappealing and thus methods and compositions for reducing their number and size are desirable.

SUMMARY

In one aspect, the present invention relates to a dry automatic dishwashing detergent composition that is free of phosphate compounds and is particularly suitable when using water having a water hardness of about 15 grains or greater. Advantageously, the composition of the present invention provides suitable cleaning of dishes that are substantially free of undesirable spots and film on the surfaces of the dishes. The term "dry" is meant to include detergent compositions formulated as a free flowing powder, individual powder "pillows" encased in a dissolvable film, tablets, or other forms that are not pourable as a liquid.

The dry detergent composition generally includes a base, a nonionic surfactant, a spot reduction system, and an enzyme system. The base may include sodium sulfate, sodium carbonate, sodium silicate, and sodium citrate and may be formulated as a free flowing powder, as tablets, or as water soluble pouches.

The nonionic surfactant comprises less than about 5% by weight of the composition and has low foaming characteristics. A number of nonionic surfactants are suitable for use in the present invention. Examples of such are the fatty alcohol ethoxylate/propoxylates and ethylene oxide/propylene oxide block polymers.

The spot reduction system includes a synergistic blend of a polyacrylate and a carboxymethyl inulin. The polyacrylate may be a sodium polyacrylate having a molecular weight from about 500 to 200,000 and comprises from about 0.5% to 2% of the detergent composition. The carboxymethyl inulin may be an alkali metal salt such as sodium and may have an average degree of substitution from about 1.5 to about 3 and comprises from about 0.05% to about 3% of the detergent composition. The enzyme system includes a synergistic blend of two protease enzymes one of which is Esperase® 6.0T. It has been found that the enzyme system exhibits enhanced food removal properties.

A bleaching agent may be added and can be an oxygen bleach selected from the group consisting of alkaline metal perborates, percarbonates, persulfates and perphosphates. The preferred bleaching agent is sodium perborate monohydrate, which contributes from about 0.3% to about 1.5% active oxygen.

In another aspect of the present invention, the detergent composition is formulated as a gel that is pourable from a container. In this regard, the gel can be formulated to have a viscosity in the range of 10,000 to 30,000 cP as measured by a Brookfield LVT viscometer using the F-sized T-bar at 12 rpm. Advantageously, it has been found that the gel formulation need not contain a phosphate or phosphonate chelating agent or a bleaching ingredient. Accordingly, the gel formulation is free of phosphate and phosphonate compounds and bleaching ingredients.

The percentages used in the following description and claims are percentages by weight of the composition, unless specifically noted otherwise.

DESCRIPTION OF THE EMBODIMENTS

Figure 1:
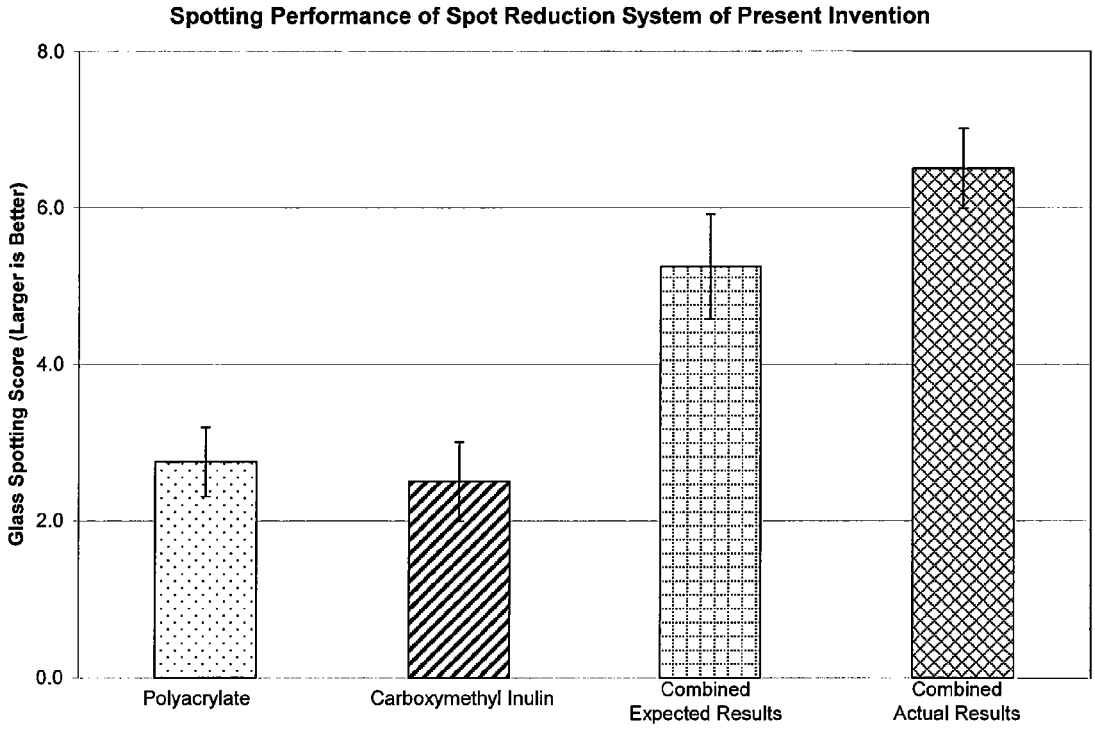
FIG. 1 is a chart that illustrates the synergism obtained from the spot reduction system that includes the combination of polyacrylate and carboxymethyl inulin according to one aspect of the present invention where the detergent was a free flowing powder.

In accordance with the present invention, a detergent is provided for use in a machine dishwasher that significantly reduces the soft water corrosion of glassware that may occur due to the use of phosphates. The formulations of the present invention provide a highly concentrated, phosphate and chlorine free automatic dishwashing detergent. In one aspect, the automatic dishwashing detergent of this invention may be supplied as a free flowing powder, individual powder "pillows" encased in a dissolvable film, tablets or other forms that are not pourable as a liquid. In another aspect, the automatic dishwashing detergent of this invention may be supplied or formulated as a pourable gel.

The powder form automatic dishwashing detergent of this invention is comprised of a base, a nonionic surfactant, a spot reduction system, an enzyme system and optionally, one or more of a bleaching agent, a bleach activator or catalyst, and a fragrance.

The base includes one or more of a sulfate, a carbonate, a citrate, and a silicate. The base may be present in an amount from about 50% to about 95% of the composition, and may be present in an amount from about 80% by weight to about 90% of the composition. The sulfate may be an alkali metal sulfate such as sodium sulfate. The sulfate may be present in an amount from about 40% to about 60% of the composition and may be present at about 50% of the composition.

The carbonate may be an alkali metal carbonate such as sodium carbonate and is present in amounts less than 25%. The carbonate may be present in an amount from about 10% to about 20% of the composition, typically about 15%. The carbonate will help to control the pH between about 9 to about 12 and will assist in controlling mineral hardness.

The citrate may be an alkali metal citrate such as sodium citrate and may be present in an amount from about 10% to about 20% of the composition, typically about 15%. The citrate may function both as a builder and as a sequestering agent.

The silicate may be an alkali metal silicate and may prevent etching of glass ware over repeated wash cycles. Suitable examples include, but are not limited to, silicates or metasilicates of either sodium or potassium. Typically, a sodium silicate or sodium metasilicate is used. Examples of sodium silicates include $Na_2SiO_3$, $Na_6Si_2O_7$, and $Na_2Si_3O_7$. Sodium silicates that have a $SiO_2$ to $Na_2O$ ratio of from 0.5:1 to 4:1 are preferred. Sodium metasilicates, such as $Na_2O_3Si$, are usually prepared from sand ($SiO_2$) and soda ash ($Na_2CO_3$). The preferred alkali metal silicate for use in this invention is sodium silicate, which is commercially available under the trade name Britesil H-20. In one embodiment of the invention, the alkali metal silicate comprises about 5% to 20% of the detergent composition and may comprise about 10%.

The nonionic surfactant useful in the present invention plays a roll in spotting and filming, helps cleaning, and is desirably a low foaming surfactant. The nonionic surfactant is present at levels of from about 0.1% to about 10% of the composition and may be present at about 1% to about 2%. Non-limiting examples of suitable nonionic surfactants include nonionic alkoxylated surfactants, especially ethoxylates derived from primary alcohols. Such ethoxylated surfactants may be derived from the reaction of a monohydroxy alcohol or alkylphenol containing from about 8 to about 20 carbon atoms, with from about 6 to about 15 moles of ethylene oxide per mole of alcohol or alkyl phenol on an average basis. An example of such a surfactant is one derived from a straight chain fatty alcohol containing from about 16 to about 20 carbon atoms ($C_{16}$-$C_{20}$ alcohol), typically a $C_{1-8}$ alcohol, condensed with an average of from about 6 to about 15 moles, typically from about 7 to about 12 moles or from about 7 to about 9 moles of ethylene oxide per mole of alcohol. Other examples of suitable nonionic surfactants can include but are not limited to those described in McCutcheon's Emuslifiers and Detergents (McCutcheon's Publications, 2005) and Handbook of Industrial Surfactants, Third Edition (Edited by Michael Ash and Irene Ash, Synapse Information Resources, Inc., 2000). The entire contents of each of these documents are incorporated herein by reference.

The spot reduction system suitable for use in this invention is comprised of a polyacrylate and carboxymethyl inulin. The system includes the polyacrylate and carboxymethyl inulin at a ratio of about 2:1 to about 3:1 and in one embodiment at about 2.5:1.

Polyacrylates are known and suitable polyacrylates include, but are not limited to, polymers and copolymers of acrylic acid, maleic anhydride, methacrylic acid, esters of these acids or acrylonitrile. Suitable polymers of the above group are sodium polyacrylate and sodium polyhydroxyacrylate. It is also contemplated to use a mixture of the various polyacrylates as the polyacrylate component of the spot reduction system. The polyacrylates useful in the present invention have a molecular weight of from about 500 to about 200,000, or from about 1,000 to about 10,000, or from about 3,000 to about 9,000. The polyacrylate may be present in an amount from about 0.5% to about 3.0%, typically about 1% of the composition.

Carboxymethyl inulin is a carboxyl-containing fructan where the carboxyl is carboxymethyl and the fructan has a β-2.1 bond. The carboxymethyl inulin is typically supplied as an alkali metal salt such as sodium carboxymethyl inulin. A suitable source of the carboxymethyl inulin is Dequest SPE 15625 from Thermphos International. The carboxymethyl inulin may have a degree of substitution ranging from about 1.5 to about 3, and may in some embodiments be about 2.5. The carboxymethyl inulin is present at relatively low levels and thus is present at less than about 3%, typically from about 0.05% to about 2.5%, and may be present from about 0.1% to about 2%.

The enzyme system of the present invention minimizes filming while providing suitable cleaning results. The enzyme system includes a combination of Esperase® 6.0T and an alkaline stable protease. Optionally, the enzyme system can also include one or more other enzymes such as amlyases.

Esperase® 6.0 T is sold by Novo Industries and has a minimum enzyme activity of 6.0 KNPU/g. and is in the class of subtilisin derived from bacillus subtillis (EC 3.4.21.62). The Esperase® 6.0T is used at relatively low levels, typically less than about 0.2% by weight and in some embodiments is present in a range from about 0.01% to about 0.1%, typically about 0.05%.

The alkaline stable protease for use in the enzyme system of the present invention may include, but is not limited to, trypsin, chymotrypsin, pepsin, papain, bromelin, carboxylase, collagenase, keratinase, elastase, amino peptidase, subtilisin and aspergillopeptidase. The alkaline stable protease useful in the enzyme system is active in a pH range of from about 4 to about 12 at a temperature of from about 50° F. to about 200° F. Although suitable proteolytic enzymes can be obtained from many commercial sources, trade formulations such as Alcalase, sold by Novo Industries of Copenhagen, Denmark; Maxatase, sold by Koninklijke Gist-Brocades NV of Delft, Holland; Protease AP, sold by Schweizerische Ferment AG of Basel, Switzerland; and Everlase and Savinase, sold by Novo Industries, are suitable in the present invention. The alkaline stable protease is present in a range from about 0.1 to about 3%, desirably between about 0.2% and about 1%, and in some embodiments at about 0.5%.

The enzyme system may include other suitable enzymes so long as they do not interfere with the advantageous non-filming properties achieved by the enzyme system. Suitable additional enzymes may include alkaline stable amylases such as those in EC 3.2.1.1 and EC 3.2.1.2. The other enzymes may be present in an amount from about 0.1% to about 1%, typically about 0.25%.

As noted above, the powder form of the dishwashing detergent may include optional ingredients such as a bleaching agent, a bleach activator or catalyst. Suitable bleaching agents are oxygen bleaches, which provide a source of available oxygen and may include water soluble percompounds such as alkaline metal perborates, percarbonates, persulfates and perphosphates as well as alkaline earth perphosphates, percarbonates and persulfates. Suitable alkali metal perborates include potassium perborate, sodium perborate tetrahydrate, and sodium perborate monohydrate. Examples of oxygen bleaches for use in the present invention are the sodium perborates and in particular, sodium perborate monohydrate. Other suitable compounds that may provide the necessary source of available oxygen for use in this invention are hydrogen peroxide and its inorganic adducts that include the aforementioned alkali metal perborates, persulfates and percarbonates. In general, any organic peracid source of available oxygen is suitable for use in the present invention. Compatible mixtures of these oxygen bleaches may be suitable for use herein. Where bleaching agents are present, they may be present in amounts from about 1% to about 10%, in some embodiments from about 3% to about 7% and may be present at about 5%. Alternatively, the bleaching agents may be present in amounts sufficient to provide from about 0.3% to about 1.5% active oxygen.

It will also be apparent to those skilled in the art that oxygen bleach activators may be suitable for use in the practice of the present invention. Bleach activators or catalysts are known and one suitable type of bleach activator is tetraacetylenediamine. Typically the bleach activator or catalyst is used in amounts less than 2% and may be present at about 1%.

Water, fragrances, and other non-essential ingredients may be present to provide a suitable product for consumers. The product may be supplied as a free flowing powder, individual powder "pillows" encased in a dissolvable film, tablets or other forms that are not pourable as a liquid.

As noted above, another aspect of the present invention includes a gel form of the detergent composition that contains the spot reduction system. The gel form of the detergent composition of the present invention will contain a base, a nonionic surfactant, a rheology modifier, a spot reduction system, suitable enzymes and a sufficient amount of water so that composition is a pourable gel. In this regard, the gel will have a viscosity greater than water and is generally formulated to have a viscosity in the range of about 10,000 to about 30,000 cP as measured by a Brookfield LVT viscometer using the F-sized T-bar at 12 rpm.

The base generally includes one or more of a silicate, a citrate, a sulfate and a carbonate. In one aspect, the gel does not contain and is free of either or both of a sulfate and a carbonate. The silicate may be an alkali metal silicate and may prevent etching of glass ware over repeated wash cycles. Suitable examples include, but are not limited to, silicates or metasilicates of either sodium or potassium. Typically, a sodium silicate or sodium metasilicate is used. Examples of sodium silicates include $Na_2SiO_3$, $Na_6Si_2O_7$, and $Na_2Si_3O_7$. Sodium silicates that have a $SiO_2$ to $Na_2O$ ratio of from 0.5:1 to 4:1 are preferred. Sodium metasilicates, such as $Na_2O_3Si$, are usually prepared from sand ($SiO_2$) and soda ash ($Na_2CO_3$). The preferred alkali metal silicate for use in this invention is sodium silicate, which is commercially available under the trade name Britesil H-20. In one embodiment of the invention, the alkali metal silicate comprises between about 5% to about 20% of the detergent composition and may comprise between about 10% to about 15% of the detergent composition.

The citrate may be an alkali metal citrate such as sodium citrate and may be present in an amount from about 2% to about 15% of the composition, in one form from about 3% to about 10%, and may be present in an amount from about 4% to about 6%. The citrate may function both as a builder and as a sequestering agent.

Citric acid may also be used and when used it will typically be premixed with water prior to adding to the mixture of water and the base. The citric acid may be provided as a 50% by weight active, which is then premixed with water. The citric acid (50% active) may be present in the composition in a range from about 1% to about 10%, or from about 2% to about 6%, or from about 3% to about 5%.

The nonionic surfactant may be the same as that described above for the powder detergent formulation. It may, however, be desirable to provide the nonionic surfactant in a liquid form. One commercial example of a suitable surfactant is Plurafac® SLF 180. The nonionic surfactant may be incorporated into the gel formulation in the range of about 0.1% to about 10%, or from about 1% to about 5%, or from about 1% to about 3% of the composition.

A rheology modifier is typically included in the gel formulation to provide the desired viscosity characteristics and aesthetically desired pouring attribute. Any suitable rheology modifier may be used so long as it does not detract from the spotting performance achieved by the present gel composition. One example of a suitable rheology modifier is a polyacrylate polymer having alkaline stability and a high degree of clarity upon neutralization. One suitable commercial product is Carbopol® 676. The rheology modifier is provided in an amount sufficient to provide the desired viscosity level. For example, the rheology modifier can be provided in an amount within a range of about 0.1% to about 2%, or from about 0.5% to about 1%.

The spot reduction system suitable for use in the gel formulation is identical with that of the powder formulation described above including the ratios and amounts.

Suitable enzymes are incorporated into the gel formulation and may be added to minimize filming while providing suitable cleaning results. The enzymes may be provided in a dry form or a liquid form with the liquid form being desired for the gel formulation. Exemplary enzymes are proteases, such as alkaline stable proteases and amylases and may include any of the enzymes described above.

The alkaline stable proteases suitable for use in the enzyme system of the present invention may include, but are not limited to, trypsin, chymotrypsin, pepsin, papain, bromelin, carboxylase, collagenase, keratinase, elastase, amino peptidase, subtilisin and aspergillopeptidase. The alkaline stable protease useful in the enzyme system is active in a pH range of from about 4 to about 12 at a temperature of from about 50° F. to about 200° F. Although suitable proteolytic enzymes can be obtained from many commercial sources, trade formulations such as Alcalase, sold by Novo Industries of Copenhagen, Denmark; Maxatase, sold by Koninklijke Gist-Brocades NV of Delft, Holland; Protease AP, sold by Schweizerische Ferment AG of Basel, Switzerland; and Everlase (Everlase 16L), which is a subtilisin identified as CAS 9014-01-1 and/or EC 232-752-2 and Savinase, sold by Novo Industries, are suitable in the present invention. The alkaline stable protease is present in a range from about 0.1 to about 3%, desirably between about 0.2% and about 2%, and in some embodiments at about 0.1%.

The amylases may include those in EC 3.2.1.1 and EC 3.2.1.2. One suitable example is Stainzyme® (Stainzyme® Plus 12L), which is an alpha amylase identified as CAS 9000-90-2 and/or EX 232-565-6. The amylase may be present in amount from about 0.1% to about 1%, or from about 0.2% to about 0.5%.

Other suitable enzymes may be present in an amount so long as they do not interfere with the advantages obtained by the present gel composition. The other suitable enzymes may be present in the composition in an amount from about 0.1% to about 1%, typically about 0.25%.

Water is provided in an amount to provide a flowable and pourable gel having the desired viscosity attributes. The gel will have a viscosity greater than water and is generally formulated to have a viscosity in the range of about 10,000 to about 30,000 cP as measured by a Brookfield LVT viscometer using the F-sized T-bar at 12 rpm.

As noted above, the gel formulation is formulated so that it does not contain a phosphate, phosphonate (e.g., aminopolyphosphonates such as amino(trismethylenephosphonate) and phosphonobutane tricarboxylic acid; alkylene polyphosphonates; hydroxyethane diphosphonate; alkylene polyamino polyphosphonate; ethylene diamino tetramethylenephosphonate, diethylene triamino pentamethylenephosphonate, dihexyleneethylene tetramino hexamethylenephosphonate and bishexamethylene triamino pentamethylenephosphonate) or a bleach (i.e. it does not contain either a chlorine bleach or an oxygen bleach). Despite the absence of these ingredients, the gel formulation containing the spot reduction system achieves superior spotting performance.

One embodiment of a powder composition within the present invention is shown below in Table 1.

TABLE 1

| Ingredient | % by Weight |
|---|---|
| Sodium Sulfate | 49.45 |
| Sodium Carbonate | 15.00 |
| Sodium Citrate | 15.00 |
| Sodium Silicate | 10.20 |
| Sodium perborate monohydrate | 4.94 |
| Tetraacetylenediamine | 0.75 |
| Nonionic Surfactant | 1.62 |
| Sodium polyacrylate (avg. 2,500 MW) | 1.00 |
| Sodium carboxymethyl inulin (2.5 DS) | 0.40 |
| Esperase ® 6.0T | 0.05 |
| Alkaline stable protease (Everlase 12T) | 0.50 |
| Alkaline stable amylase | 0.25 |
| Water, fragrance | 0.84 |

The following Examples are meant to illustrate the principles of the present invention and not to limit the invention.

Tests were conducted to determine the effect of the polymer system and the enzyme system of the present invention. The test method outlined in ASTM D 3556-85 was followed with a few minor variations. First, instead of using a 1-5 scale, a 1-9 scale was used in an effort to increase the degree of precision. Like the 1-5 scale used in ASTM D 3556-85, a 1 indicates a flawless glass while the top end of the scale indicates a glass completely covered in spots for the spotting reading and an extremely heavy film for the filming reading. The method gives latitude for water hardness and number of washes as long as these parameters remain the same between comparisons. The water hardness was 15 grain water hardness and 5 cycles were used. Fifteen grams of detergent having the composition of Table 1 but for the polyacrylate, carboxymethyl inulin, and the enzymes per cup per cycle was used. The polyacrylate and carboxymethyl inulin were added to the detergent compositions in amounts shown in Table 2. At the completion of the five cycles, the glassware was read by expert readers. The average of these readings can be seen below in Table 2.

TABLE 2

| Formula | Spotting | Filming | Total |
|---|---|---|---|
| 1.0% Polyacrylate (avg. 2,500 MW) | 7.25 | 1.50 | 7.25 |
| 0.4% Carboxymethyl Inulin (2.5 DS) | 7.50 | 2.125 | 7.50 |

TABLE 2-continued

| Formula | Spotting | Filming | Total |
|---|---|---|---|
| 1.0% Polyacrylate (avg. 2,500 MW) and 0.45 Carboxymethyl Inulin (2.5 DS) | 3.50 | 2.00 | 3.50 |

The polyacrylate had a molecular weight of approximately 2,500 g/mol and the carboxymethyl inulin had a 2.50 average degree of substitution. The combination of the polyacrylate and carboxymethyl inulin exhibited substantially better overall performance than either the polyacrylate or carboxymethyl inulin alone. To better illustrate the results, the scale was reversed by subtracting each score from ten (thus a higher score meant less spotting and filming whereas lower scores meant greater spotting and filming). The expected performance was calculated by adding the scores of the results of the two individual polymers. The results are shown in Table 3.

TABLE 3

| Formula | Spot-ting | Opposite Spotting | Film-ing | Opposite Filming | Total | Opposite Total |
|---|---|---|---|---|---|---|
| 1.0% Polyacrylate (avg. 2,500 MW) | 7.25 | 2.75 | 1.50 | 8.50 | 8.75 | 11.25 |
| 0.4% Carboxy-methyl Inulin (2.5 DS) | 7.50 | 2.5 | 2.125 | 7.875 | 9.625 | 10.375 |
| Expected Results from Individually Added Results | NA | 5.25 | NA | 16.375 | | 21.625 |
| Tested Formula (1.0% Polyacrylate (avg. 2,500 MW) and 0.4% Carboxymethyl Inulin (2.5 DS)) | 3.50 | 6.50 | 2.00 | 8.00 | 5.50 | 14.50 |

It will be appreciated that the polymer system according to the present invention (1.0% Polyacrylate (avg. 2,500 MW) and 0.4% Carboxymethyl Inulin (2.5 DS)) provides better spotting performance than additive effect of each individual polymer. The results of the spotting performance are plotted in chart identified as FIG. 1.

Additional testing was conducted relating to the enzyme system. It is known that Esperase® 6.0T, while effective, is very expensive. Accordingly, a combination of the Esperase® 6.0T with another protease was investigated. A food removal test was conducted by measuring the reflectance reflectance before and after one wash (15 g detergent per cup (the detergent had the composition of Table 1 but for the enzymes, which were added as shown in Table 4), 15 grain water hardness) on three protein tiles purchased from the Center for Test Materials. The tiles were soiled with egg yolk, egg milk and minced meat. After the reflectance data was gathered, an average percent improvement for the three tiles was calculated. Finally, this number was normalized to a sample that contained no enzyme. The data is shown in Table 4.

TABLE 4

| Enzyme Description | Tile Description | Avg Initial Reflectance | Avg Final Reflectance | Difference | Percent Improvement | Avg % Improvement | Normalized Avg % Improvement |
|---|---|---|---|---|---|---|---|
| 0.050% Esperase | DM #21, Egg Yolk | 87.0 | 89.0 | 2.0 | 2.30 | 1.46 | 4.59 |
| 6.0T, 0.500% Everlase | DM #31, Egg Milk | 87.1 | 87.3 | 0.2 | 0.23 | | |
| 12T | DM #91, Minced Meat | 91.1 | 92.8 | 1.7 | 1.87 | | |

TABLE 4-continued

| Enzyme Description | Tile Description | Avg Initial Reflectance | Avg Final Reflectance | Difference | Percent Improvement | Avg % Improvement | Normalized Avg % Improvement |
|---|---|---|---|---|---|---|---|
| 0.000% Esperase | DM #21, Egg Yolk | 87.9 | 84.3 | −3.6 | −4.10 | −3.13 | 0.00 |
| 6.0T, 0.000% Everlase | DM #31, Egg Milk | 87.1 | 82.4 | −4.7 | −5.40 | | |
| 12T | DM #91, Minced Meat | 91.4 | 91.5 | 0.1 | 0.11 | | |
| 0.000% Esperase | DM #21, Egg Yolk | 88.2 | 88.6 | 0.4 | 0.45 | 0.51 | 3.64 |
| 6.0T, 0.500% Everlase | DM #31, Egg Milk | 88.1 | 87.9 | −0.2 | −0.23 | | |
| 12T | DM #91, Minced Meat | 91.1 | 92.3 | 1.2 | 1.32 | | |
| 0.050% Esperase | DM #21, Egg Yolk | 88.2 | 85.2 | −3.0 | −3.40 | −2.82 | 0.31 |
| 6.0T, 0.000% Everlase | DM #31, Egg Milk | 87.0 | 82.8 | −4.2 | −4.83 | | |
| 12T | DM #91, Minced Meat | 91.1 | 90.9 | −0.2 | −0.22 | | |
| Both Enzymes | DM #21, Egg Yolk | NA | NA | NA | NA | NA | 3.96 |
| Expected Results | DM #31, Egg Milk | NA | NA | NA | NA | | |
| | DM #91, Minced Meat | NA | NA | NA | NA | | |

Figure 2:
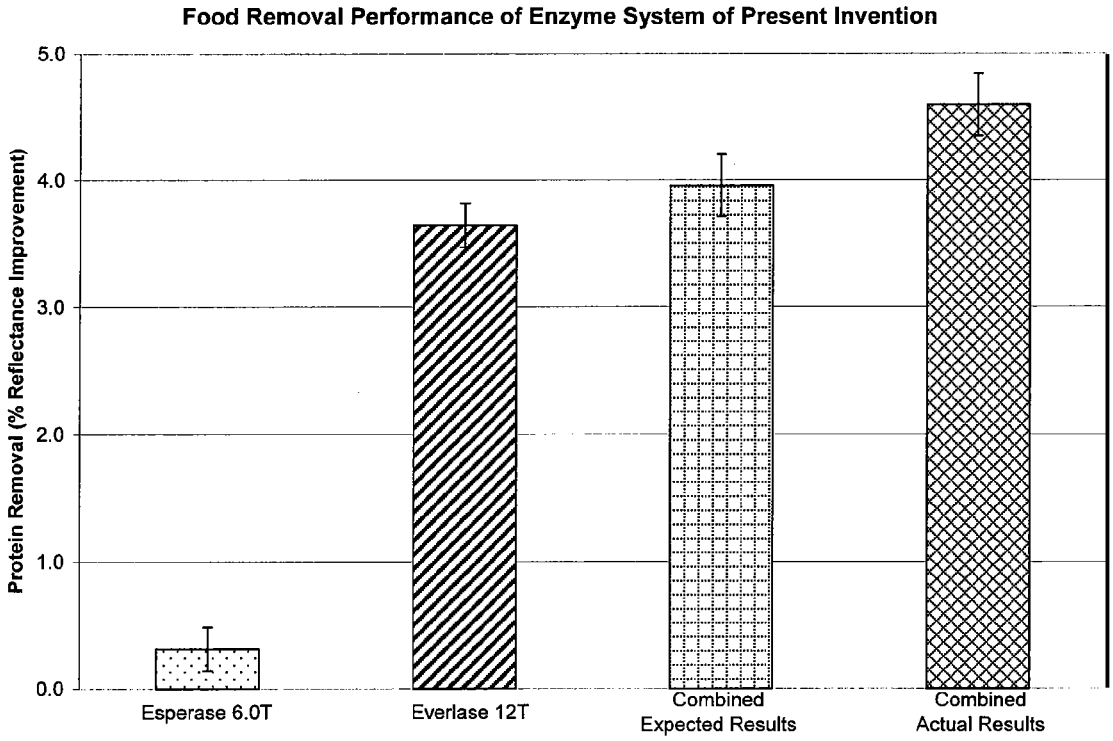
FIG. 2 is a chart that illustrates the synergism obtained from the enzyme system that includes the combination of Esperase® 6.0T and an alkaline stable protease.
Figure 3:
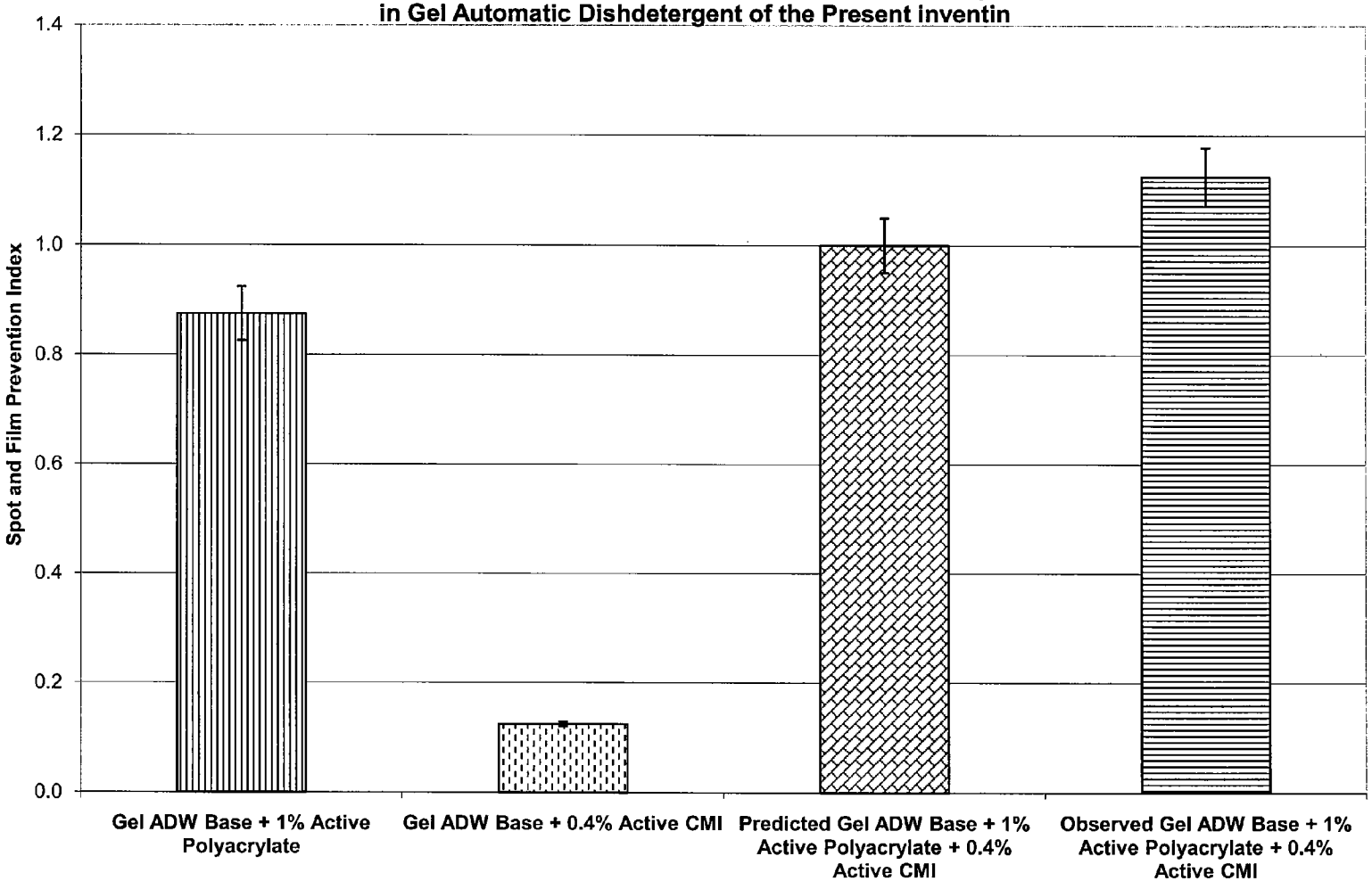
FIG. 3 is a chart that illustrates the synergism obtained from the spot reduction system that includes the combination of polyacrylate and carboxymethyl inulin according to one aspect of the present invention where the detergent was formulated as a gel.

The Normalized Average percent improvement is plotted on the chart identified as FIG. 2. It can be seen that the enzyme system of the present invention (0.05% Esperase® 6.0T and 0.5% Everlase 12T) produces an effect that is better than the additive effect of the individual enzymes.

One embodiment of a gel composition within the present invention is shown below in Table 5.

TABLE 5

| Ingredient | % by Weight |
|---|---|
| Water (Soft) | 72.40 |
| Sodium Silicate | 13.00 |
| Sodium Citrate | 5.00 |
| Citric Acid (50%) | 3.50 |
| Nonionic Surfactant | 2.0 |
| Sodium polyacrylate (avg. 8,000 MW) | 1.0 |
| Sodium carboxymethyl inulin (2.5 DS) (40% active) | 1.0 |
| Rheology Modifier (polyacrylate) | 0.80 |
| Alkaline stable protease (Everlase 16L) | 1.0 |
| Alkaline stable amylase | 0.3 |

The gel composition of Table 5 had a viscosity of about 25,000 cP as measured by a Brookfield LVT viscometer using the F-sized T-bar at 12 rpm.

Tests were conducted to determine the effect of the spot reduction system of the present invention on spotting and filming of glass ware. The test method outlined in ASTM D 3556-85 was followed with a few minor variations. First, instead of using a 1-5 scale, a 1-9 scale was used in an effort to increase the degree of precision. Like the 1-5 scale used in ASTM D 3556-85, a 1 indicates a flawless glass while the top end of the scale indicates a glass completely covered in spots for the spotting reading and an extremely heavy film for the filming reading. The method gives latitude for water hardness and number of washes as long as these parameters remain the same between comparisons. The water hardness was 20 grain water hardness and 5 cycles were used. Fifteen grams of the gel detergent having the composition of Table 5 but for the polyacrylate and carboxymethyl inulin per cup per cycle was used. The polyacrylate and carboxymethyl inulin were added to the detergent compositions in amounts shown in Table 6. At the completion of the five cycles, the glassware was read by expert readers.

To better illustrate the results, the scale was reversed by subtracting each score from ten (thus a higher score meant less spotting and filming whereas a lower score meant greater spotting and filming). Then, the reversed scores for each were subtracted from the reversed control score (i.e., that obtained by the gel base with no polyacrylate or carboxymethyl inulin). The results are shown in Table 6. The expected performance was calculated by adding the scores of the results of the two individual polymers.

TABLE 6

| Formula | Filming | Spotting | Total |
|---|---|---|---|
| Gel Base + 1% Active Polyacrylate (avg. 8,000 MW) | 0.750 | 0.125 | 0.875 |
| Gel Base + 0.4% Active Carboxymethyl Inulin (2.5 DS) | 0.000 | 0.125 | 0.125 |
| Expected Results from Individually Added Results | | | 1.000 |
| Observed Gel Base + 1% Active Polyacrylate (avg. 8,000 MW) + 0.4% Active Carboxymethyl Inulin (2.5 DS) | 1.000 | 0.125 | 1.125 |

Although the present invention has been described with respect to specific embodiments, it should be understood that the invention contemplates other uses and methods. In that regard, other embodiments of the present invention will be apparent to those skilled in the art from a consideration of the specification. It is therefore intended that the specification be considered as illustrative only and that this invention is not limited to the particular embodiment described above.

What is claimed is:

1. A method of reducing water spotting on dishes washed in an automatic dishwasher comprising treating the dishes with a pourable phosphate and phosphonate-free gel dishwashing composition comprising:

a. from about 7% to about 35% of a base that includes one or more of a silicate and a citrate;

b. from about 0.1% to about 10% of a nonionic surfactant;

c. from about 0.55% to about 4% of a spot reduction system that includes (i) a polyacrylate and (ii) a carboxymethyl inulin, wherein the ratio of polyacrylate to carboxymethyl inulin is from about 2:1 to about 3:1;

d. water; and, e. a rheology modifier, wherein the water and rheology modifier are present in respective amounts such that the gel has a viscosity in the range of 10,000 to 30,000 cP as measured by a Brookfield LVT viscometer using the F-sized T-bar at 12 rpm.

2. The method of claim 1 wherein the composition is further mixed with water having a hardness of 15 grains or greater.

3. The method of claim 1 wherein the polyacrylate has a molecular weight from about 500 to about 200,000.

4. The method of claim 3 wherein the polyacrylate is present in the composition in the range from about 0.5% to about 1.5%.

5. The method of claim 1 wherein the carboxymethyl inulin has a degree of substitution from about 0.15 to about 3.

6. The method of claim 1 wherein the carboxymethyl inulin is sodium carboxymethyl inulin having a degree of substitution from about 1.5 to about 3 and wherein the carboxymethyl inulin is present in the composition in the range from about 0.05% to about 2.5%.

7. The method of claim 1 wherein the silicate is present in the composition in the range from about 5% to about 20% and the citrate is present in the composition in the range from about 2% to about 15%.

8. The method of claim 1 wherein the composition includes an amount of citric acid in the range of about 0.5% to about 5%.

9. The method of claim 1 wherein the rheology modifier is present in an amount from about 0.1% to about 2%.

10. The method of claim 1 wherein the composition does not contain an oxygen bleach.

11. The method of claim 1 wherein the composition does not contain a bleach.

12. A method of reducing water spotting on dishes washed in an automatic dishwasher comprising treating the dishes with a pourable phosphate and phosphonate-free gel dishwashing composition comprising:

a. from about 5% to about 20% of a silicate;

b. from about 2% to about 15% of a citrate;

c. from about 0.5% to about 5% of citric acid;

d. from about 0.1% to about 10% of a nonionic surfactant;

e. from about 0.55% to about 4% of a spot reduction system that includes (i) a polyacrylate and (ii) a carboxymethyl inulin, wherein the ratio of polyacrylate to carboxymethyl inulin is from about 2:1 to about 3:1;

f. water; and, g. a rheology modifier, wherein the water and rheology modifier are present in respective amounts such that the gel has a viscosity in the range of 10,000 to 30,000 cP as measured by a Brookfield LVT viscometer using the F-sized T-bar at 12 rpm.

13. The method of claim 12 wherein the composition does not contain an oxygen bleach.

14. The method of claim 12 wherein the composition does not contain a bleach.

* * * * *